US007690700B2

(12) United States Patent
Neumann

(10) Patent No.: US 7,690,700 B2
(45) Date of Patent: Apr. 6, 2010

(54) DOOR LATCH DEVICE FOR A DOMESTIC APPLIANCE, IN PARTICULAR FOR A DISH WASHER

(75) Inventor: Thomas Neumann, Konnersreuth (DE)

(73) Assignee: emz-Hanover GmbH & Co. KGaA, Nabburg (DE)

( * ) Notice: Subject to any disclaimer, the term of this patent is extended or adjusted under 35 U.S.C. 154(b) by 176 days.

(21) Appl. No.: 11/835,699

(22) Filed: Aug. 8, 2007

(65) Prior Publication Data

US 2008/0042447 A1 Feb. 21, 2008

(30) Foreign Application Priority Data

Aug. 10, 2006 (DE) ..... 10 2006 037 494

(51) Int. Cl.
*E05C 19/10* (2006.01)

(52) U.S. Cl. ..... 292/126; 292/121; 292/110; 292/DIG. 61

(58) Field of Classification Search ..... 292/126, 292/4–8, 10–11, 14, 21, 56–61, 70–74, 63–68, 292/95–111, 121–125, 137–159, 163–169, 292/DIG. 4, DIG. 26, DIG. 62, DIG. 69; 126/191, 197; 134/57

See application file for complete search history.

(56) References Cited

U.S. PATENT DOCUMENTS 5,997,056 A * 12/1999 Yamagishi ..... 292/341.17

(Continued)

FOREIGN PATENT DOCUMENTS

DE 3426738 A1 1/1986

DE 102004023608 A1 12/2004

OTHER PUBLICATIONS

Certified Translation of Office Action from the German Patent and Trademark Office in priority document of this application, Application No. DE 10 2006 037 494.0.

*Primary Examiner*—Peter M. Cuomo
*Assistant Examiner*—Mark Williams
(74) *Attorney, Agent, or Firm*—Robert R Deleault, Esq.; Mesmer & Deleault, PLLC

(57) ABSTRACT

A door latch device for a domestic electrical appliance, in particular for a dishwasher, has a frame (10) provided or to be provided on a first component of the domestic appliance, a latching unit (28) arranged so it can be displaced relative to the frame between an open position and a latched position for engagement with a closure system of a second component of the domestic appliance that can be moved relative to the first appliance component and is to be locked with respect thereto, and a latching spring assembly that pre-tensions the latching unit and which in the open position of the latching unit forces the unit into engagement with a blocking surface (24) that blocks relaxation of the latching spring assembly. According to one aspect of the invention a control member (52) that is separate from the latching unit and arranged so it can be moved relative thereto is provided, comprising an application system (64) for an actuating portion of the second appliance component and comprising an impact system for a block-cancelling effect on the latching unit. According to a further aspect the latching unit is formed by a one-piece latching body on which, in addition to a latching system (38) for engagement with the closure system of the second appliance component and a blocking system (50) for engagement with the blocking surface (24), supporting surfaces for the latching spring assembly are also arranged.

22 Claims, 8 Drawing Sheets

U.S. PATENT DOCUMENTS 7,032,939 B2 4/2006 Magnusson
7,195,293 B2 * 3/2007 Ala ..... 292/254
7,503,722 B2 * 3/2009 Chou ..... 403/325
2005/0194795 A1 9/2005 Hapke et al.

* cited by examiner

DOOR LATCH DEVICE FOR A DOMESTIC APPLIANCE, IN PARTICULAR FOR A DISH WASHER

CROSS-REFERENCE TO RELATED APPLICATIONS

This application claims the benefit of German Patent Application No. DE 10 2006 037 494.0, filed Aug. 10, 2006, in the European Patent Office.

BACKGROUND OF THE INVENTION

1. Field of the Invention

The present invention relates generally to a door latch device for a domestic electrical appliance, in particular a dishwasher. Particularly, the present invention relates to a door latch for a domestic electrical appliance comprising a frame provided or to be provided on a first component of the domestic appliance, a latching unit arranged so it can be displaced relative to the frame between an open position and a latched position for engagement with a closure system of a second component of the domestic appliance that can be moved relative to the first appliance component and is to be closed with respect thereto, and a latching spring assembly that pre-tensions the latching unit and which in the open position of the latching unit forces the unit into engagement with a blocking surface that blocks relaxation of the latching spring assembly.

2. Description of the Prior Art

Domestic electrical appliances for which the door latch device being considered here is suitable comprise a housing with a door opening which can be closed by a door that is movably hung on the appliance housing. The door latch device can be installed in the appliance housing or the door. In a preferred, although in no way limiting, embodiment the door latch device is fitted in the upper part of the appliance housing and engages downwards with a latching nose in a latching depression in the door.

A door latch device of the above-stated, generic type is known for example from US 2005/194795 A1. In this case the latching unit comprises a swivel part and a linearly movable slide that rotatably holds the swivel part about an axis of rotation. An arrangement of a plurality of pre-tensioning springs acts between the slide and a frame of the latching device. The force of the pre-tensioning springs forces the swivel part against an abutment secured to the frame. The circumferential contour of the swivel part has different radii, so, depending on the rotary position of the swivel part, the axis of rotation thereof is distanced from the abutment to a greater or lesser extent, and the pre-tensioning springs are tensioned more or less strongly accordingly.

The swivel part according to US 2005/194795 A1 comprises a gripping recess for a hook. In an unlocked rotary position, the gripping recess faces the hook so the hook can move into it as the door of the domestic appliance is being closed. In this rotary position, the swivel part is supported on the abutment with a part of its circumference which is located more radially outwards. The pre-tensioning springs are more strongly tensioned accordingly. If the hook moves into the gripping recess it presses against an edge thereof, and this introduces a rotation into the swivel part. In the process, with a sliding edge on which the edge portion of the swivel part which is located more radially outwards merges into an edge portion which is located more radially inwards, the rotary part moves past the abutment. This allows the pre-tensioning springs to relax, whereby the slide and the swivel part snap back in the direction of the abutment. At the same time the hook is locked in the gripping recess. It is only possible to turn back the swivel part if the slide and the swivel part are moved, against the force of the pre-tensioning springs, away from the abutment again, so the swivel part can be moved with its sliding edge in the opposite direction past the abutment again. This reverse movement of the swivel part is assisted by a restoring spring.

SUMMARY OF THE INVENTION

By contrast, according to the invention a generic door latch device is distinguished according to a first approach by a control member that is separate from the latching unit and arranged so it can be moved relative thereto, comprising an application system for an actuating portion of the second appliance component and comprising an impact system for a block-cancelling effect on the latching unit. This solution allows the latching unit to be freed from application systems on which the second appliance can act to introduce a block-cancelling movement of the latching unit from the open position. With the solution according to US 2005/194795 A1 the edge surface of the gripping recess forms such an application system, i.e. the application system is formed directly on the swivel part and therewith on the latching unit. With the solution according to the above, first approach of the invention on the other hand the application systems can be provided on the control member—and therewith separate from the latching unit. This allows greater freedom in the design of the latching unit since it is accordingly freed from a function that still applies to it in US 2005/194795 A1. On the other hand the control member can be optimally configured with respect to action by the second appliance component.

The first appliance component can be an appliance housing of the domestic appliance and the second appliance component can be a door hung on the appliance housing. However, as already indicated above, it is not impossible for the door latch device to be fitted in the door of the domestic appliance. In this case the door forms the first appliance component while the appliance housing forms the second appliance component.

The control member is preferably arranged on the frame. It is of course basically conceivable to arrange the control member on the latching unit itself.

The control member is preferably a pivotally mounted control lever which carries the impact system on a first lever arm and the application system on a second lever arm. As a function of the leverage, the lever design of the control member allows a reduced force (to be applied by a user) to cancel blocking of the latching unit in the open position and to disengage the unit from the blocking surface. At the same time however there must be no curtailments in the pre-tensioning force applied by the latching spring assembly, so secure, tight closing of the door may still be ensured.

The control member is expediently pre-tensioned by springs, so following actuation of the latching unit it can automatically reset itself to a standby position.

In dishwashers and other domestic electrical appliances, such as ovens and microwave appliances, automatic recognition of the properly closed state of the door is often sought. This can take place for example by means of an electric switch which has a different switching status when the door is properly closed than when it is open. To actuate this kind of switch the control member can carry a switch activation element which is intended and constructed to activate an electric switch when the control member is moved from a standby position in the direction of a block-cancelling position. The switch activation element can, for example, be a magnet which is used to activate a magnetic field-actuated switch, in particular a reed contact. Alternatively the switch activation element can be constructed for mechanically actuating an electric switch. The arrangement of the switch activation element on the control member couples the switch actuation to the movement of the control member.

According to a further embodiment a switch actuating member that can be moved between a switch deactivation position and a switch activation position independently of the control member can be arranged on the frame and this is intended and constructed to actuate an electric switch on movement into the switch activation position. To avoid mistaken activation of the switch, in the open position of the latching unit the switch actuating member can be blocked thereby against movement into the switch activation position. Only after the latching unit has left the open position, and in particular only after its blocking has been cancelled, can the switch actuating member be released for movement into the switch activation position.

According to a second approach a door latch device of the generic type described in the introduction is distinguished according to the invention by a switch actuating member arranged on the frame and which can be moved between a switch deactivation position and a switch activation position and which is intended and constructed to actuate an electric switch on movement into the switch activation position, wherein, in the open position of the latching unit, the switch actuating member is blocked thereby against movement into the switch activation position and is only released for movement into the switch activation position after leaving the open position, in particular after block-cancelling of the latching unit.

A third approach of the invention provides that with a generic door latch device the latching unit is formed by a single latching body on which, in addition to a latching system for engagement with the closure system of the second appliance component and a blocking system for engagement with the blocking surface, supporting surfaces for the latching spring assembly are also arranged. The one-piece design of the latching unit simplifies the degree of production and assembly complexity compared with constructions with a multi-part latching unit. The latching body in particular can be produced in one piece.

According to an advantageous embodiment the latching body is constructed as an elongate slide which is longitudinally displaceably and pivotally arranged in the frame. The latching system of the latching body can be arranged in the region of a first of its longitudinal ends, wherein the latching body can be pivoted about a swivelling axis which passes through the latching body at least approximately in the region of the second longitudinal end thereof.

The latching system of the latching body can be constructed as a latching nose which is intended and constructed for engagement in a latching depression of the second component used as a closure system. Within the scope of the invention it is obviously not impossible to choose other forms for the latching system of the latching body. For example the latching system of the latching body can also be constructed as a locking mouth.

The latching body preferably comprises two longitudinal side legs that extend at a spacing from each other and between which the latching spring assembly is accommodated. The longitudinal side legs can be connected in the region of the first longitudinal end of the latching body by a transverse connecting region that carries the latching system, but are unconnected over a main part of their length extending up to the second longitudinal end of the latching body. This is advantageous in terms of assembly since the latching spring assembly can simply be introduced into the latching body through the open second longitudinal end thereof. The unconnected legs ends of the latching body can be slightly spread apart to create sufficient clearance for entry of the latching spring assembly. In the region of the second longitudinal end of the latching body the longitudinal side legs can also form supporting surfaces for the latching spring assembly while in the region between the two longitudinal ends of the latching body there can be arranged an abutment system via which the latching spring assembly is supported relative to the frame.

The situation can occur where the latching body is unintentionally brought into the latched position while the door to the domestic appliance is still open, for example as a result of improper handling of the door latch device. To still be able to close the door in this kind of situation it is recommended that in its latched position the latching body has play in the sense of a movement of its latching system out of the path of movement of the closure system of the second appliance component, and in that the abutment system is formed by an abutment member supported and movably, in particular pivotally, arranged on the frame and which allows the latching body to be lifted against elastic force out of the path of movement of the closure system of the second appliance component. This functionality of the door latch device can be called self-healing. It allows the latching body to avoid the approaching second appliance component and then snap back again under the effect of the elastic force if the closure system of the second appliance component has arrived in a position of engagement with respect to the latching body. From a more general perspective which constitutes a fourth approach of the invention, the self-healing functionality in a generic door latch device can be achieved in that in the region of its latched position the latching unit can be lifted against elastic force out of the path of movement of the closure system of the second component.

According to a further, fifth approach, with a door latch device of the generic type the invention provides that the latching unit comprises a latching nose which is intended and constructed for engagement in a latching depression of the second appliance component, wherein the latching unit is movably arranged in the frame in such a way that in the course of a movement of the latching unit from the open position into the latched position the latching nose executes a first movement in the sense of insertion into the latching depression and a second movement which is directed transversely to the first, wherein the latching nose executes at least most of the first movement while the latching unit is still in blocking engagement with the blocking surface and executes at least most of the second movement once the latching unit is released from blocking engagement with the blocking surface.

The above-described aspects according to the various approaches of the invention can be realised on a generic door latch device individually or in any desired combinations.

The latching spring assembly can comprise a single latching spring, in particular a compression spring, wherein it is of course not impossible that, alternatively, a plurality of, in particular simultaneously acting, latching springs can be provided in the latching spring assembly.

As a child-proof lock an arresting element constructed for manual operation can be held on the frame so as to be movable, in particular pivotal, relative thereto and which in the region of the latched position of the latching unit can be brought into arresting engagement therewith. To open the door it is then necessary first of all to disengage the arresting element by hand from the latching unit before the door can be opened against the effect of the latching spring assembly.

BRIEF DESCRIPTION OF THE DRAWINGS

The invention will be described in more detail hereinafter with reference to the accompanying drawings.

DETAILED DESCRIPTION OF THE PREFERRED EMBODIMENT

Figure 1:
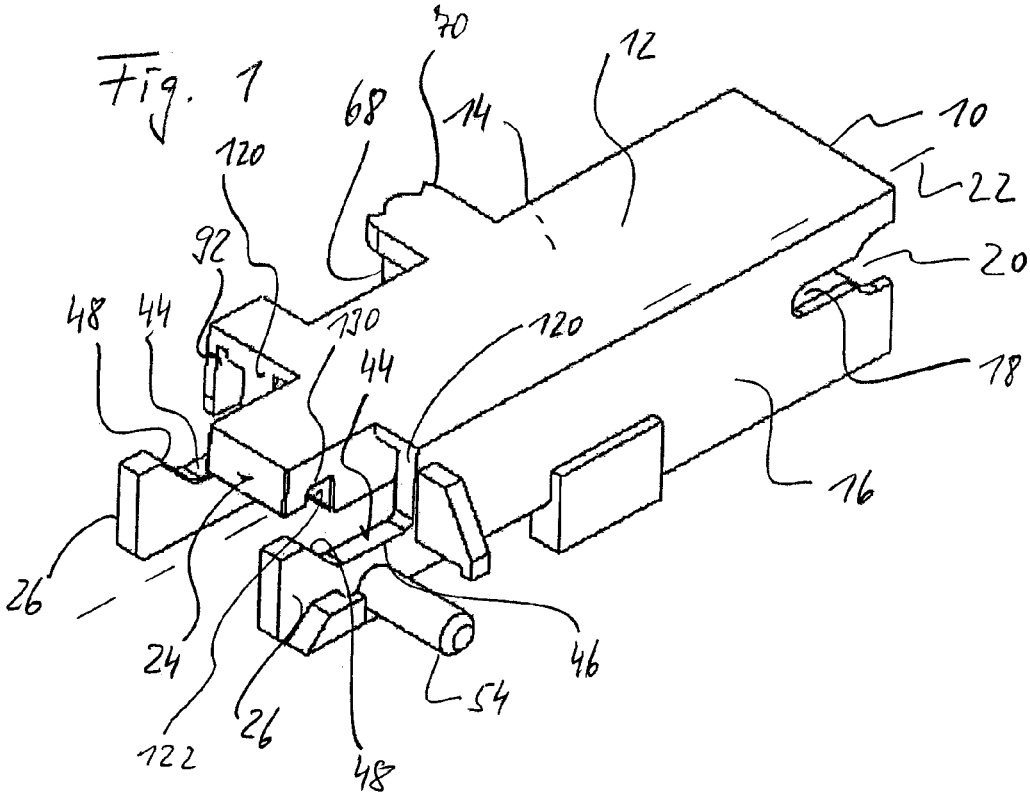
FIG. 1 shows a perspective view of a frame of a door latch device according to a first embodiment of the invention, FIG. 2 perspectively shows a latching body for the first embodiment, FIG. 3 perspectively shows a control member for the first embodiment, FIG. 4 perspectively shows a hand-operable arresting lever for the first embodiment, FIG. 5 perspectively shows the door latch device according to the first embodiment in an assembled state.

The preferred embodiment(s) of the present invention is illustrated in FIGS. 1-16. FIG. 1 shows a frame 10 which can also be called a lock frame or a lock housing. The frame 10 has a frame upper part 12, two frame side parts 14, 16 and a frame lower part 18 which together form a receiving space 20 for receiving further components of the door latch device. It is preferably a component produced in one piece which, for example, can be manufactured from plastics material by injection moulding. The frame 10 has an elongate shape with an imaginary frame longitudinal axis 22. To establish clear terminology the frame region located bottom left in FIG. 1 is designated "leading" and the region located top right in the same figure is designated "trailing".

The frame upper part 12 has a blocking surface 24 that is directed axially forwards. The frame side parts 16 comprise a respective lug 26 that projects forwards in the leading frame region.

Figure 2:
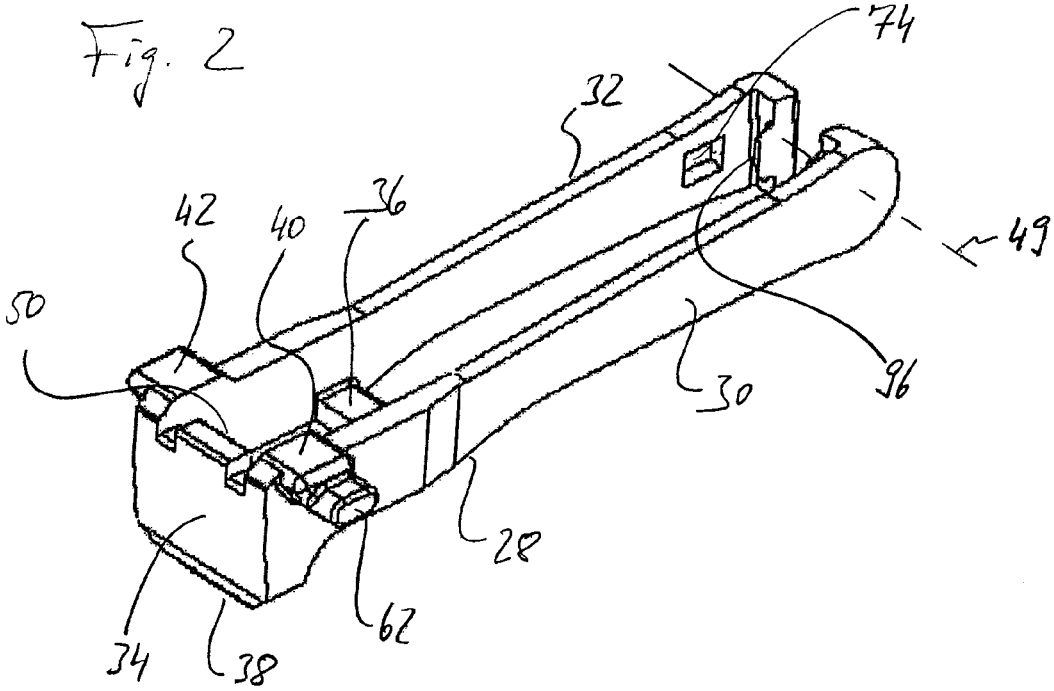

FIG. 2 shows a latching body 28 which forms a one-part latching unit according to the invention. The latching body comprises two elongate side legs 30, 32 that extend side by side at a spacing from each other. In the region of the leading ends (i.e. in the region located bottom left in FIG. 2) the two side legs 30, 32 are connected together by a transverse connecting region 34 which is called a first transverse web hereinafter. They are unconnected however in the region of their trailing ends (i.e. in the part located top right in FIG. 2). At a spacing behind the first transverse web 34 but at a substantially greater spacing in front of the trailing ends of the longitudinal legs 30, 32 there is located a second transverse web 36 which is also used to connect the longitudinal legs 30, 32. Owing to the absence of a connection in the trailing region the longitudinal legs 30, 32 are flexible relative to each other here and in particular they can be spread apart from each other. By contrast, in the leading region the latching body 28 is comparatively rigid and distortion-resistant, and in the relevant embodiment this can be attributed inter alia to the dual connection by way of the two transverse webs 34, 36 but can also be achieved by increased material thickness of the longitudinal legs 30, 32 in the leading region.

The leading transverse web 34 projects downwards and beyond the longitudinal legs 30, 32 and with its downwardly projecting part forms a latching nose 38. Overall the latching body 28 thus has an approximate L-shape when viewed from the side, wherein the long L-leg is formed by the side legs 30, 32 and the short L-leg by the transverse web 34 with the latching nose 38. In the leading region of the latching body 28 there projects from either side thereof a respective catch 40, 42. On their upper side the lugs 26 also form a respective catch guideway 44 with an axial lengthwise portion 46 which at the front merges into an obliquely rising sloping portion 48.

When the door latch device is assembled the latching body 28 is inserted in the frame 10 and projects with its side legs 30, 32 20 inside the receiving space 20 far into the trailing frame region. The catches 40 are located above the catch guideways 44. The latching body 28 is longitudinally displaceable in the frame 10. At the same time it can be swivelled in the frame, namely about a swivelling axis which in the region of its trailing side legs ends passes through the frame. FIG. 2 shows an imaginary swivelling axis of the latching body 28 at 49. To achieve such mobility of the latching body 28 its trailing side leg ends and the interior of the frame can be constructed in such a way that the trailing side legs ends can move substantially only in the longitudinal direction in the frame 10 but substantially not in the vertical direction (i.e. transversely to an imaginary plane defined by the longitudinal axis 22 and the swivelling axis 49). Toward the front the latching body 28 can however have play in the frame 10 in the vertical direction, so, overall, swivelling mobility of the latching body 28 is established around the trailing side leg ends.

The sloping portions 48 of the catch guideways 44 can impart an upwards movement to the leading latching body region (i.e. bring about an upwards swivelling of the latching body 28) if in the event of forwards displacement of the latching body 28 the catches 40, 42 meet the sloping portions 48. With this kind of upwards swivelling of the latching body 28 the transverse web 34 moves with a blocking edge designated 50 in FIG. 2 in front of the blocking surface 24. With its blocking edge 50 the transverse web 34 forms a blocking system of the latching body 28 that cooperates with the blocking surface 24 according to the invention. In the illustrated embodiment the blocking edge 50 is simultaneously the upper edge of the transverse web 34. This does not have to the case. The blocking edge 50 can be formed by any desired axial shoulder of the transverse web 34.

Reference should be made to the fact that with its blocking edge 50 the transverse web 34 can also arrive in front of the blocking surface 24 without the cooperation of the sloping portions 48. The force and lever ratios inside the door latch device can in particular be such that with a forwards displacement of the latching body 28, a torque acts on the latching body 28 which allows it to automatically swivel upwards as soon as the blocking edge 50 has moved axially past the blocking surface. In such a case the sloping portions 48, and sometimes even the entire catch guideways 44, can be omitted if desired.

In the region of its longitudinal portions 46 the catch guideways 44 can be used as a longitudinal guide for the latching body 28 if the catches 40, 42 rest on the longitudinal portions. Of course this does not have to the case. The catches 40, 42 can also be disconnected from the catch guideways 44 at least over a portion of the longitudinal displacement path of the latching body 28. As mentioned above, if required, the catch guideways 44, and therewith the lugs 26, can even be omitted completely.

Figure 3:
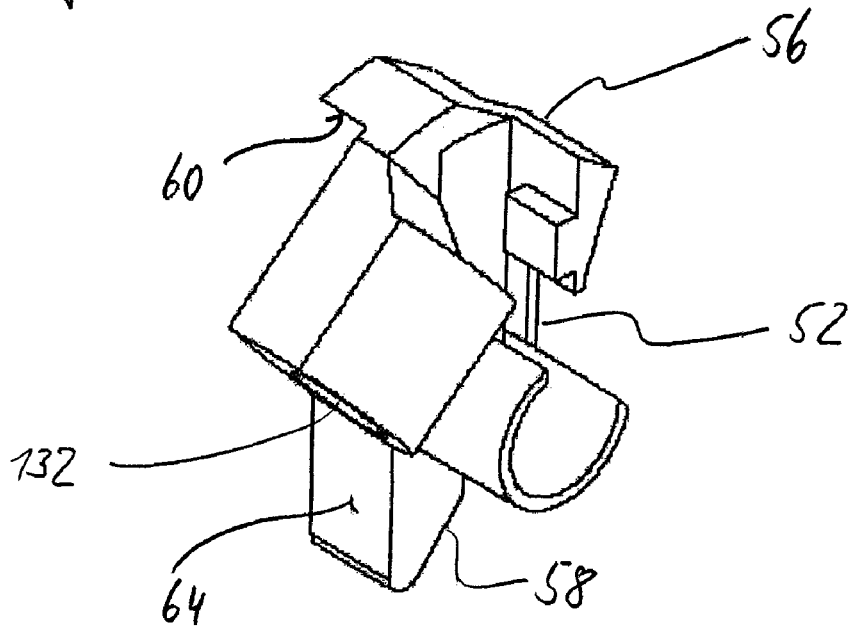

Reference will now also be made to FIG. 3. This shows a control lever 52 which when the door latch device is assembled is placed on a journal 54 which at one of the frame side parts, in the example of FIG. 1 the frame side part 16, is constructed so as to laterally protrude. The control lever 52 comprises a first lever arm 56 and a second lever arm 58. An impact surface 60 used as an impact system according to the invention is formed on the lever arm 56 and is constructed to introduce a block-cancelling movement into the latching body 28. The impact surface 60 cooperates with an actuating system 62 of the latching body 28 which in the example of FIG. 2 is constructed as a projection of the catch 40. An application surface 64 is provided on the lever arm 58 and is constructed to act by way of a door that is to be locked by means of the door latch device.

Figure 4:
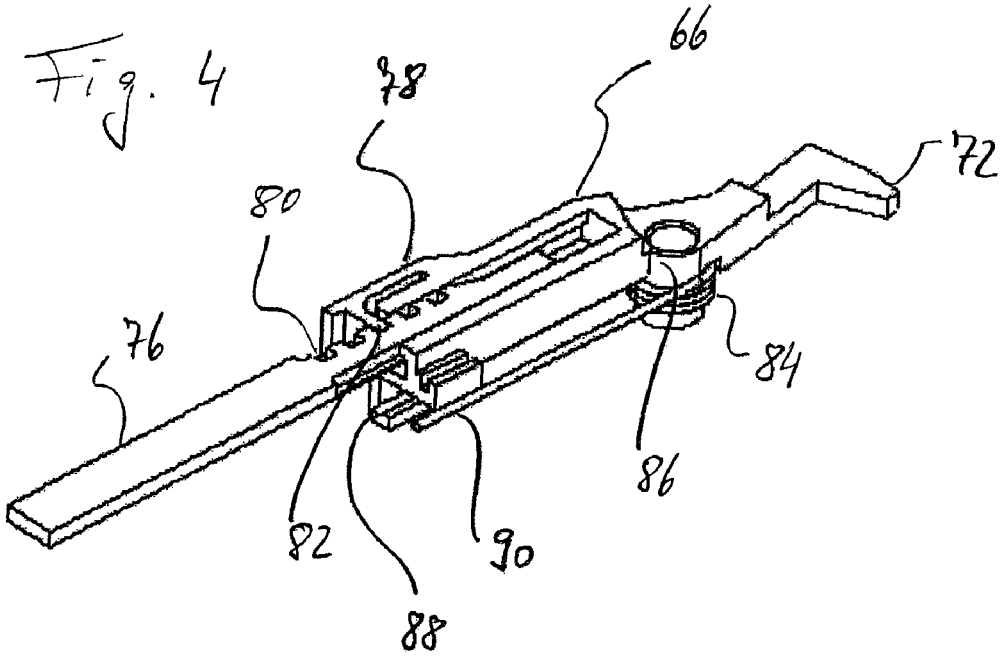

FIG. 4 shows an arresting lever 66 used as a child-proof lock and which is constructed for swivel-mounting on a further journal 68 of the frame 10. In the example of FIG. 1 this journal 68 is arranged at a lateral spacing from the frame side part 14 on a holding web 70 that projects laterally away from the frame upper part 12. In the region of the end of one of its lever arms the arresting lever 66 comprises an arresting hook 72 which is constructed for arresting engagement in an arresting recess 74 which is formed in one of the side legs 30, 32 (the side leg 32 in the example of FIG. 2) of the latching body 28. In the illustrated embodiment the arresting recess 74 is located close to the trailing end of the latching body 28 but it can, for example, also be arranged in a central region of the latching body 28.

The other lever arm of the arresting lever 66 comprises a handle portion 76 which allows manual operation of the arresting lever 66. In the example of FIG. 4 the handle portion is formed by a separate handle profile which is arranged on a main body 78 of the lever so as to be adjustable in length. The capacity for lengthwise adjustment is ensured by an arrangement of positioning recesses 80 moulded one behind the other in the handle profile and spaced-apart in the longitudinal direction of the profile. Depending on the desired effective length of the handle portion 76 a positioning projection 82 formed on the main body 78 of the lever can optionally be brought into engagement with any of the positioning recesses 80. It is understood that in a modified embodiment the arresting lever 66 cannot be constructed so as to be adjustable in length. In this case the handle portion 76 is permanently connected to the main body 78 of the lever, in particular in one piece.

A pre-tensioning spring 84 which is arranged on a bearing portion 86 of the arresting lever 66 designed to receive the journal 68 allows pre-tensioning of the arresting lever 66 in the direction of engagement of the arresting hook 72 with the arresting recess 74. The spring 84 comprises two spring ends 88, 90, of which one—in FIG. 4 the one designated 88—is hung on the arresting lever 66 and of which the other—the one designated 90 in FIG. 4—can be hung on the frame 10. A hanging system which allows hanging of the spring end 90 can be seen in FIG. 1 at 92. This hanging system 92 is configured in such a way that the spring end 90 can be hung and removed at any time by the user as required. The spring pre-tensioning force that acts on the arresting lever 66 can thus be activated and deactivated as desired. It is understood that the pre-tensioning spring 84 can also be dispensed with. In this case the arresting lever 66 must be moved manually to arrest the latching body 28 and to release the locking device.

Figure 5:
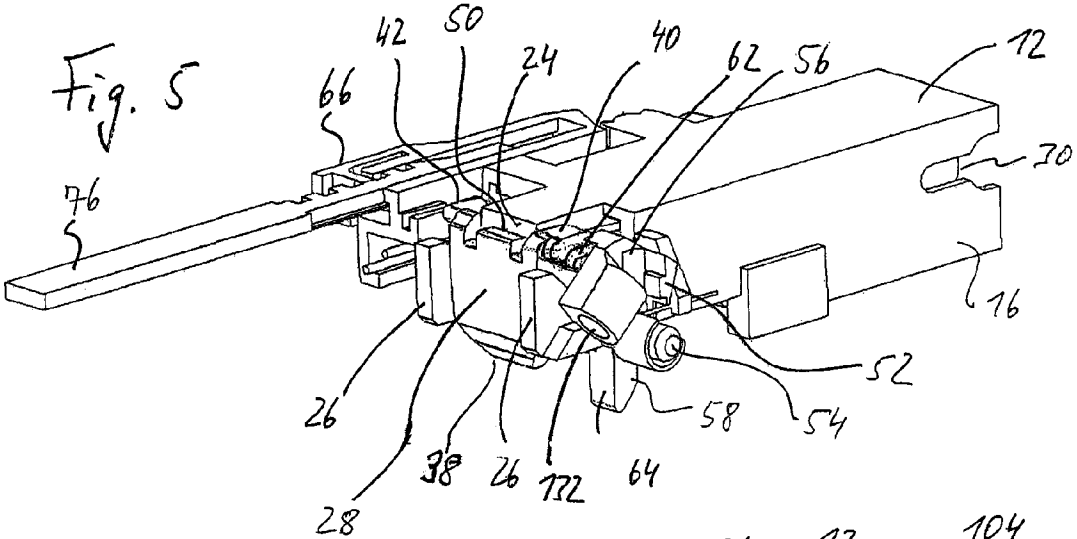
Figure 6:
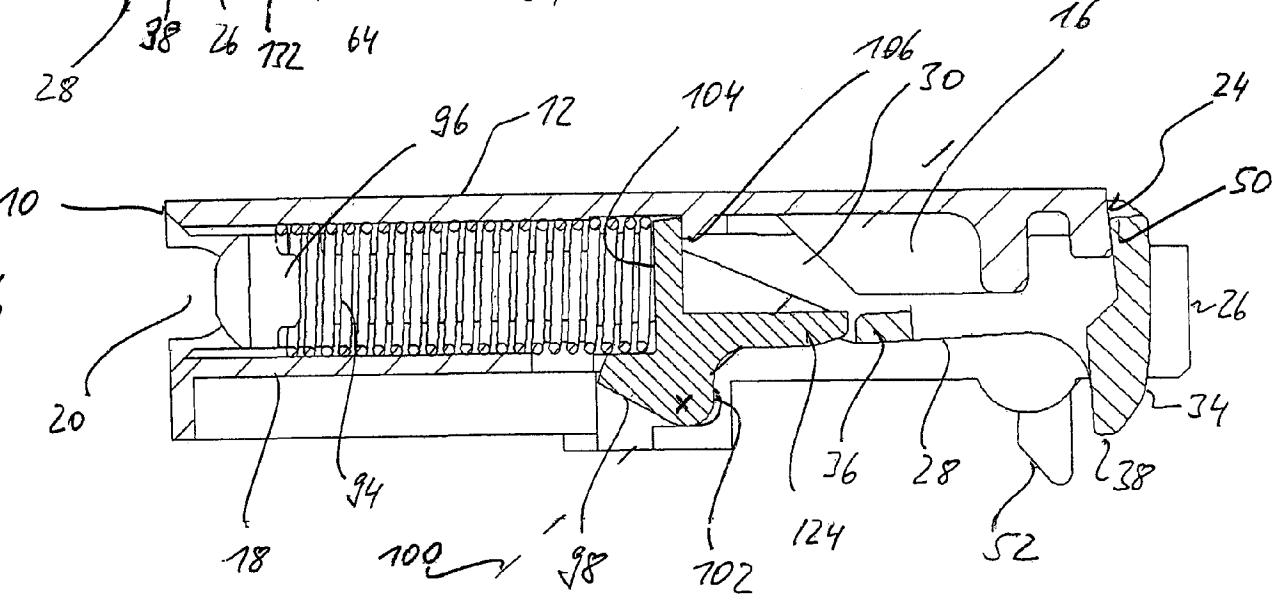
FIG. 6 shows a longitudinal section through the door latch device of FIG. 5, FIGS. 7 and 8 show various phases during closing of the door of a domestic appliance equipped with the door latch device according to the first embodiment.

Reference will now also be made to FIGS. 5 and 6 in which the door latch device is shown with the components shown in FIGS. 1 to 4 in the assembled state. In both of these figures the latching body 28 is shown in a position which can be called an open or unlocked position. In the unlocked position the blocking edge 50 of the transverse web 34 of the latching body 28 is located in front of the frame-side blocking surface 24. A latching spring 94, a compression spring in the illustrated example, received between the side legs 30, 32 of the latching body 28 exerts a pre-tensioning force on the latching body 28 that acts at the back in the longitudinal direction and thus pre-tensions the latching body against the blocking surface 24.

The latching spring 94 is supported on the one hand on the two trailing ends of the side legs 30, 32 of the latching body 28 which can each have a securing hook 96 that engages in the latching spring for this purpose. On the other hand the latching spring 94 is supported on an abutment member 98 which is mounted in the receiving space 20 of the frame 10 so as to swivel about a swivelling axis indicated at 100. For its swivel mounting the abutment member 98 comprises two journals 102 that protrude on either side (of which only one can be seen to some extent in FIG. 6) which are rotatably held in catch mounts in the frame 10 (not shown in detail). The abutment member 98 comprises a supporting leg 104 on which the latching spring 94 is supported by its leading end. A stop rib 106 that projects from the frame upper part 12 inwardly into the receiving space 20 forms a swivel limit stop for the abutment member 98. FIG. 6 shows the abutment member 98 in an abutting position in which its supporting leg 104 is forced into abutment against the stop rib 106 by the force of the latching spring 94. The forces exerted by the latching spring 94 on the abutment element 98 are guided in this abutting position across the frame-side catch bearing for the swivel journals 102 and across the stop rib 106 into the frame 10. From the abutting position in FIG. 6 the abutment member 98 can be swivelled counter to the effect of the latching spring 94 in such a way that its supporting leg 104 tilts rearwards and thus ensures stronger compression of the latching spring 94. In the approach of FIG. 6 the abutment member 98, starting from the abutting position shown therein, can be swivelled counter-clockwise about the axis 100.

Figure 7:
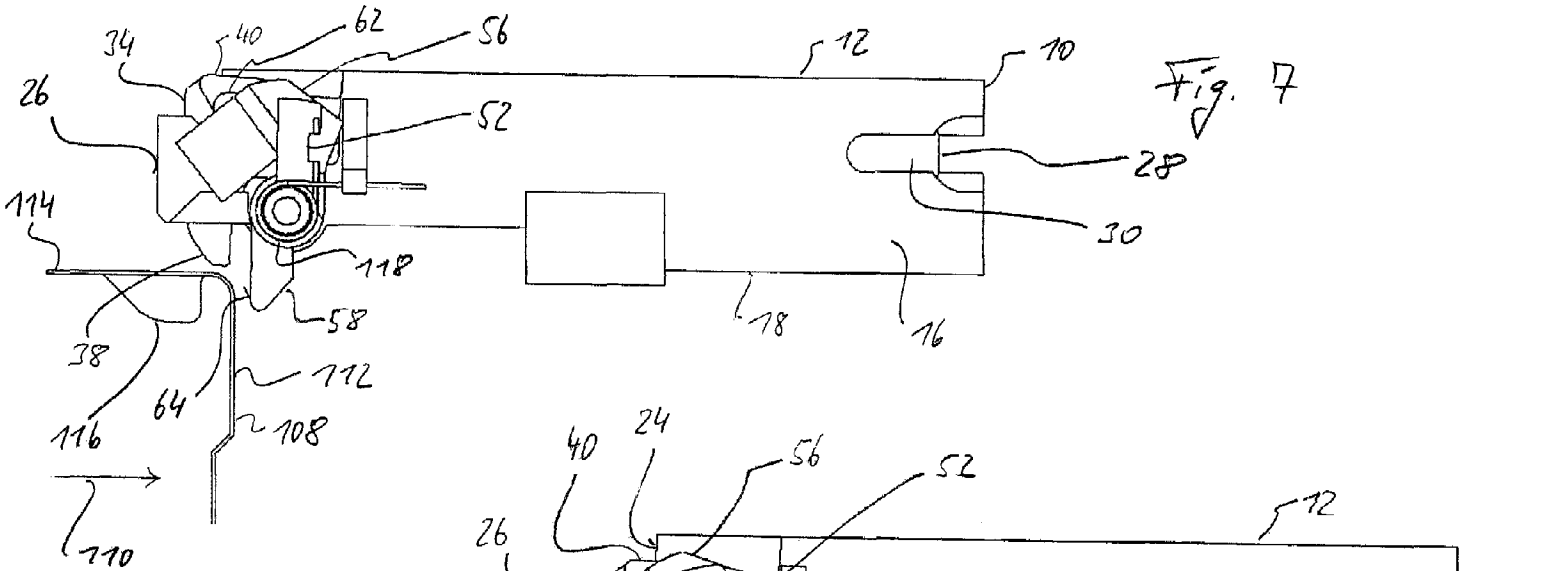
Figure 8:
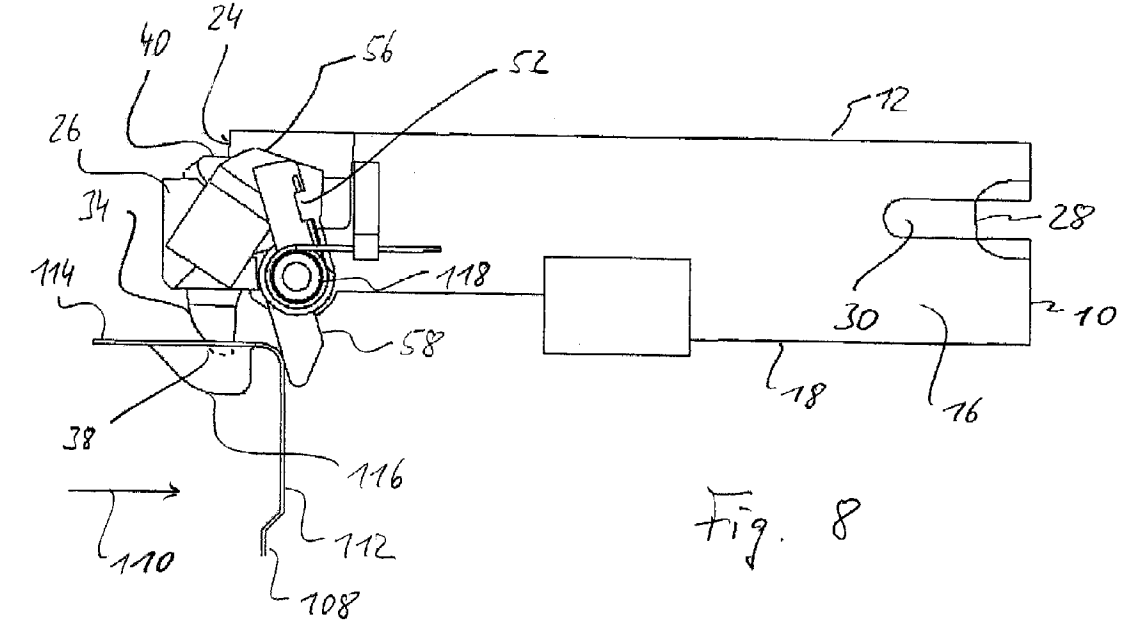
Figure 9:
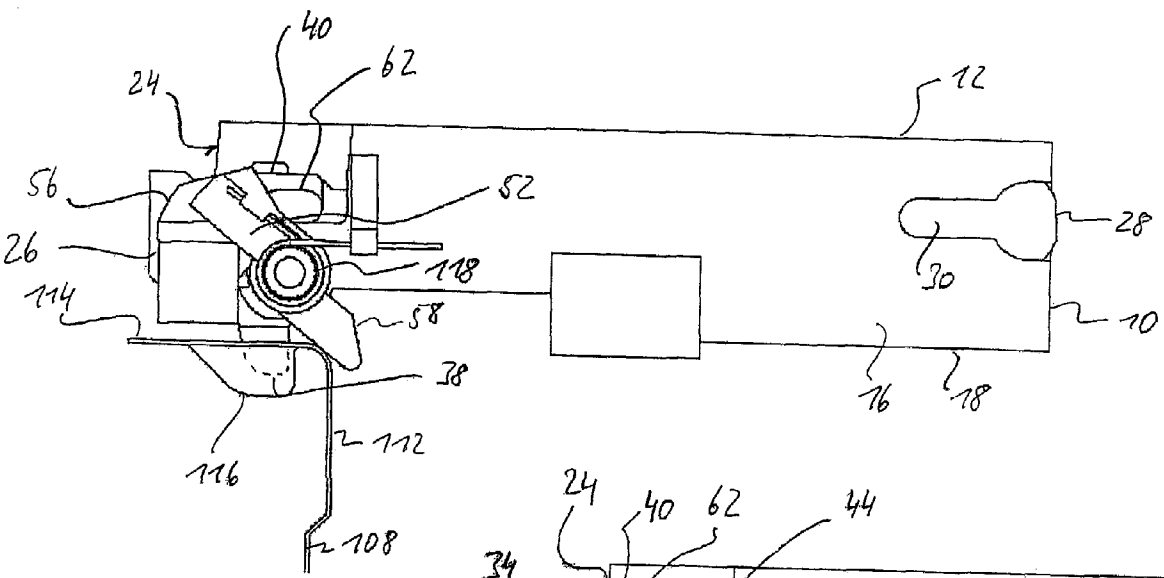
FIG. 9 shows a properly latched state of the door latch device according to the first embodiment.

The mode of operation of the door latch device when the door is closed will now be described with reference to FIGS. 7 to 9. It is assumed in this case that the assembly in FIG. 5 is fitted in a housing of a domestic appliance, in particular a dishwasher and the door is used to close a door opening in the housing. In FIGS. 7 to 9 the door is indicated at 108. When it is closed it moves toward the door latch device and relative thereto in a direction indicated by arrow 110. The door comprises a front side 112 that leads in the direction of closing 110. At a spacing from the front side 112 and in its upper side designated 114 there is moulded a depression-shaped latching recess 116.

It can be seen in FIG. 7 that by means of a pre-tensioning spring 118 the control lever 52 is pre-tensioned in a position relative to the frame 10 in which the latching body 28 can assume its unlocked position. In the unlocked position the latching nose is located above the door 108 and outside of the path of movement thereof, as can clearly be seen in FIG. 7.

In many cases the door 108 can be provided on the housing of the domestic appliance so as to swivel. The straightness of the directional arrow 110 should not be understood as a limitation to a linear movement, instead the arrow 110 should also be representative of a swivelling movement of the door 108. It is used merely to indicate the general direction of movement of the door 108 relative to the door latch device, without implying an exact course of movement in the process.

As the door 108 approaches the door latch device the door edge situated at the transition between the front side 112 and upper side 114 moves past the latching nose 38 until with its front side 112 or said door edge the door 108 meets the application surface 64 on the lower lever arm 58 of the control lever 52. The control lever 52 is swivelled hereby counter to the force of the pre-tensioning spring 118 out of its rest or standby position according to FIG. 7. Swivelling of the control lever 52 causes the impact surface 60 (see FIG. 3) provided on the upper lever arm 56 to execute a movement along an arc of a circle during which it engages with the actuating system 62 of the latching body 28 (if it is not in contact with the actuating system 62 from the start). During the course of its downwards movement the impact surface 60 presses the actuating system 62 downwards.

The downwards movement of the actuating system 62 induced by the control lever 52 causes a simultaneous downwards movement of the latching nose 38 which accordingly begins to be inserted into the latching depression 116 of the door 108. Owing to the pre-tensioning force of the latching spring 94 the transverse web 34 with its blocking edge 50 remains in contact with the blocking surface 24, i.e. the blocking edge 50 slides down the blocking surface 24. In this phase the latching nose 38 executes a substantially linear, downwardly directed movement. The movement of the latching body 28 as a whole is substantially a downward swivelling in this phase, wherein a slight compensating movement caused by the linearity of the downwards movement of the latching nose 38 can occur in the longitudinal direction.

With further swivelling of the control lever 52, and therefore further downward movement of the latching nose 38, the blocking edge 50 finally slides under the locking surface 24. This cancels blocking of the latching body 28 with the result that the latching spring 94 is relaxed and pulls the latching body 28 backward in the longitudinal direction. The latching spring 94 relaxes to the extent that the latching body 28 again abuts against a stop provided on the frame. The stop can, for example, be formed by stop surfaces 120 or/and 122 (FIG. 1) of the frame 10.

FIG. 9 shows the state following relaxation of the latching spring 94 and retraction of the latching body 28. As the latching body 28 is retracted the latching nose 38 inserted in the latching depression 116 carries the door 108 backwards along with it. The door is thus securely pressed against the appliance housing, preferably with simultaneous compression of a door seal, not shown but conventional per se. The state following relaxation of the latching spring 94 and retraction of the latching body 28 can be called the latching or locking position of the latching body 28.

The movement of the latching nose 38 with relaxation of the latching spring 94 is substantially a backwards longitudinal movement without significant movement components in the upwards or downwards directions. In other words, as the latching body 28 is transferred from its unlocked position to the locked position the latching nose first of all executes a substantially linear downwards movement during which it is inserted into the latching depression 116. It then executes a substantially backwards linear movement that is approximately perpendicular hereto, wherein the latching body as a whole also substantially executes no—or only a slight—swivelling movement. While the insertion phase of the latching nose 38 proceeds without significant longitudinal movement of the latching body 28 therefore, during the retraction phase of the latching body 28 there is substantially a purely translatory movement.

Reference will again be made to FIG. 6. During the downward movement of the latching nose 38 the second transverse web 36 of the latching body 28 moves downward. During the subsequent retraction movement of the latching body 28 the transverse web 38 moves below a hold-down leg 124 of the abutment member 98 which extends substantially at a right angle to the supporting leg 104. An upward swivelling of the latching body 28 is basically possible in the locked position albeit only against the force of the latching spring 94 since the latching spring 94 pre-tensions the abutment member 98 into the position according to FIG. 6.

Figure 10:
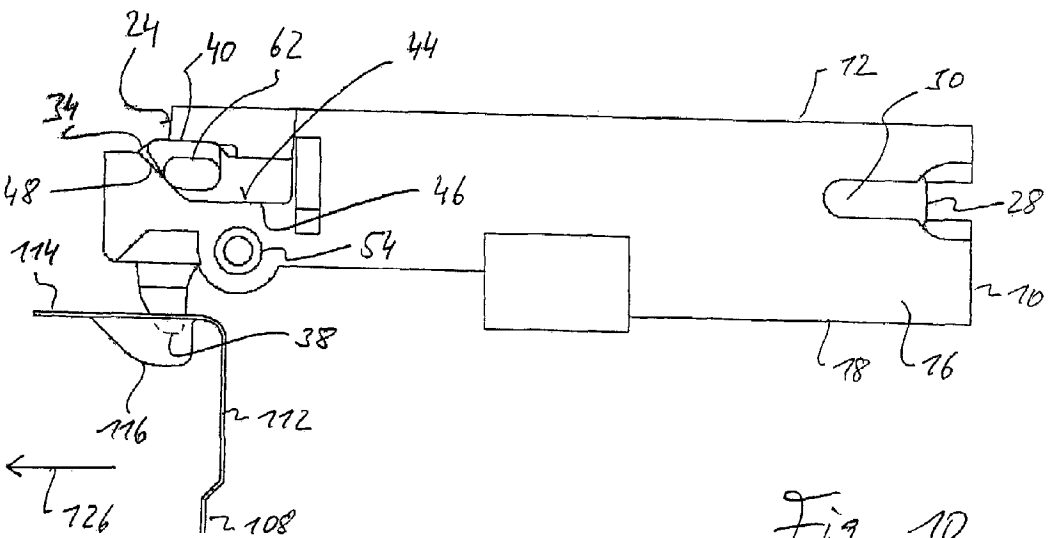
FIG. 10 shows a phase during opening of the door from the latched state of the door latch device according to the first embodiment.

FIG. 10 shows a phase during opening of the door 108. The door 108 must be moved away, relative to the frame 10, in the direction of movement opposite to the latching direction 110 in this connection (indicated by an arrow 126), and, more precisely, counter to the force of the latching spring 94. During this movement the latching nose 38 that is inserted in the latching depression 116 and therewith the latching body 28 as a whole is carried along in the forwards direction. The force and lever ratios in the door latch device or/and the sloping portions 48 of the catch guideways 44 cause an upward movement of the latching body 28, as a consequence of which the blocking edge 50 arrives in front of the blocking surface 24 again. The locking nose 38 only completely exits the latching depression 116 once the blocking edge 50 has moved in front of the blocking surface 24. This thus prevents the latching body 28 from unintentionally snapping back into its locked position.

The control lever 52 has been omitted in FIG. 10 for the sake of improved clarity. It is nevertheless still easy to comprehend that it returns in the reverse direction of swivelling from the position of FIG. 9 into the rest position in FIG. 7 as the door 108 is opened. This resetting of the control lever 52 is brought about or assisted by the pre-tensioning spring 118.

The situation can occur where the latching body 28 is in its latched position without the door 108 being closed at the same time. The door 108 can still be closed even in a case such as this. The door latch device has a self-healing functionality in this regard.

Figure 11:
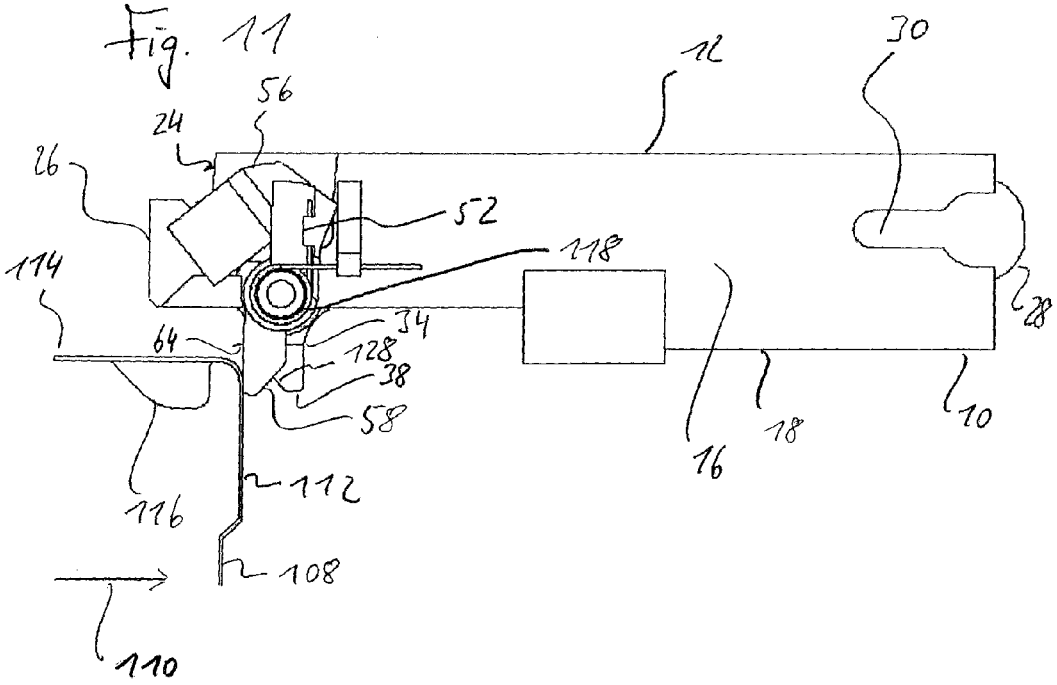
FIGS. 11 and 12 show phases during a self-healing latching process.
Figure 12:
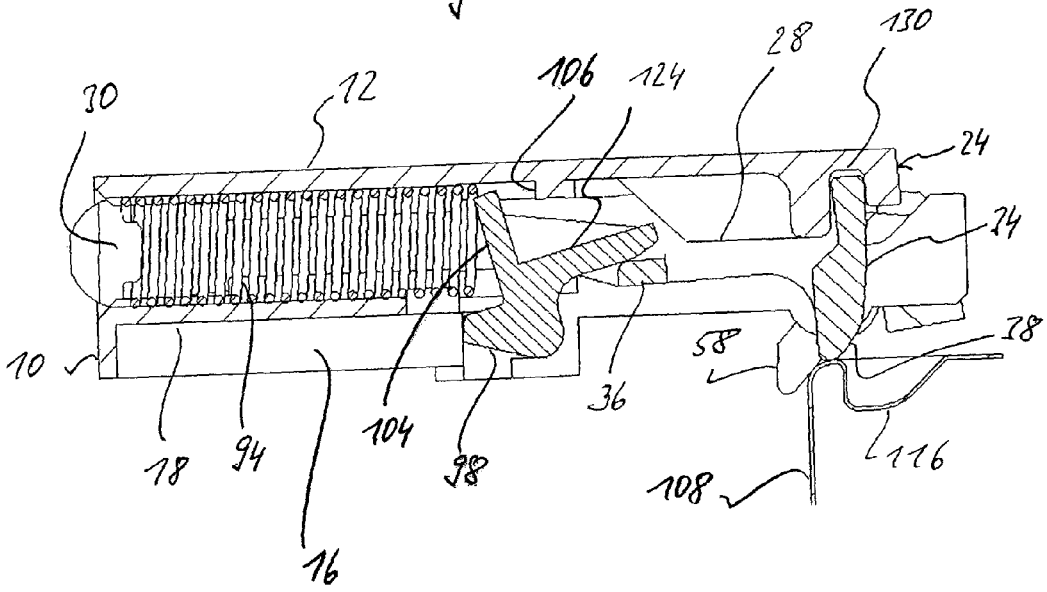

Reference will be made to FIGS. 11 and 12 to describe the self-healing functionality. If the door 108 is closed (movement in arrow direction 110) when the latching body 28 is already in its latched or locked position, the door 108 first of all meets the application surface 64 of the control lever 52 and swivels the lever against the force of the pre-tensioning spring 118. In this regard the situation is comparable with that during proper closing of the door 108—see FIG. 8. The door 108 then meets the latching nose 38 however which is in its locked position in the path of movement of the door 108. At its side that faces the door the latching nose 38 has a lifting bevel 128 which is intended to cooperate with the door edge at the transition between door front side 112 and door upper side 114. If the door edge meets the lifting bevel 128 it presses the latching nose 38 upward, i.e. the latching nose moves out of the way. The door 108 is thus given space for the movement past the latching nose 38.

The frame 10 is configured in such a way that it offers the latching body 28, in particular the transverse web 34, the requisite space to move away, i.e. in its latched position the latching nose 28 has play, in particular swivelling play, in the sense of lifting of the latching nose 38 from the path of movement of the door 108. In FIG. 12 a passing indentation 130 is provided for this purpose on the lower side of the upper part 12 of the frame, into which indentation the transverse web 34 can be inserted. To deflect the latching nose 38 a latching force has to be exerted on the door 108 which is large enough to overcome the counteracting pre-tensioning force of the latching spring 94. This acts on the latching body 28 via the hold-down leg 124 of the abutment member 98. If the applied door closing force is sufficient the transverse web 36 pushes the hold-down leg 124 upwards. This causes the abutment member 98 to swivel into the self-healing position of FIG. 12.

As soon as the door 108 with its latching depression 116 has moved below the latching nose 118, which has receded upwards, the latching spring 94 presses the latching body 28 into its locked position again via the abutment member 98. The latching nose 38 is inserted into the latching depression 116 hereby and locks the door 108.

Figure 13:
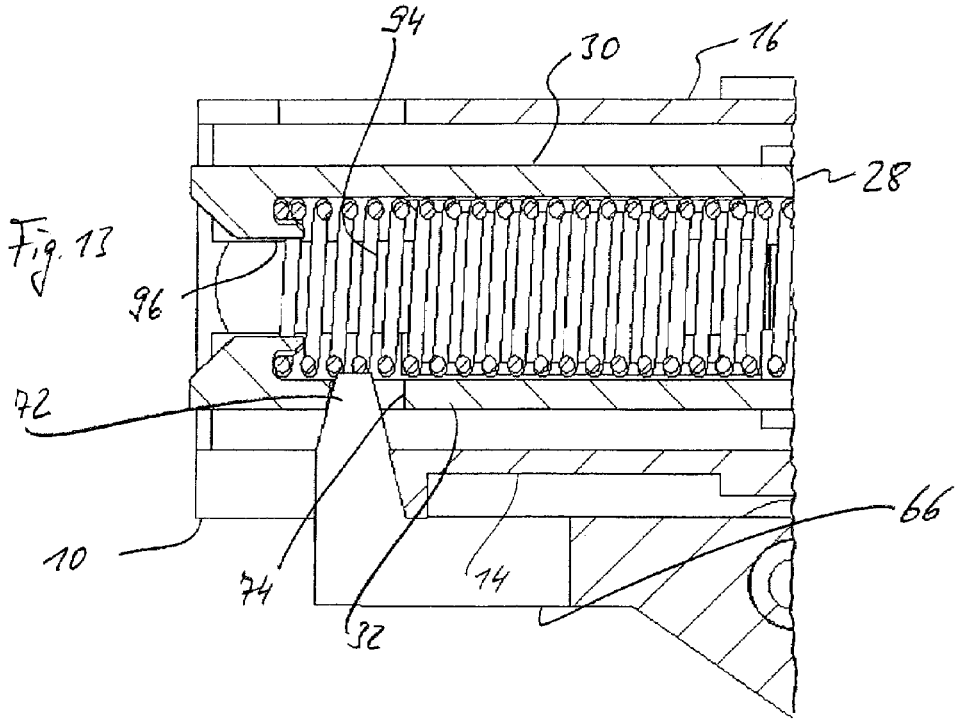
FIG. 13 shows in a sectional view the engagement of the arresting hook of the arresting lever in the latching body of the door latch device according to the first embodiment.

FIG. 13 shows arresting of the latching body 28 in the locked position by means of the arresting lever 66. It can be seen how the arresting hook 72 engages in the arresting recess 74 of the side leg 32 of the latching body 28. To open the appliance door the arresting lever should firstly be manually actuated against the pre-tensioning force of the spring 84 in order to move the arresting hook 72 out of the arresting recess 74. The door can then be opened in accordance with the above statements relating to FIG. 10. In a manner not shown the engagement between arresting lever 66 and latching body 28 can be configured as an emergency aid as an oblique surface engagement which with a sufficiently large opening force on the latching body 28 causes the arresting hook 72 to be pressed out of the arresting recess 74 and the door can also be opened without actively actuating the arresting lever 66.

In the embodiment described thus far the control lever 52 carries a switch activating magnet 132 which can best be seen in FIG. 5. When the control member 52 is swivelled from the rest position according to FIG. 7 into the position according to FIG. 9 the switch activating magnet 132 approaches a magnetic field-actuated switch, in particular a reed contact, which is fitted in the door 108 but not shown in detail in the figures. The magnetic field of the approaching magnet 132 brings about a switching actuation of the switch. The closed, locked state of the door can thus be detected in terms of circuitry.

According to one variant the magnetic field-actuated switch can comprise a Hall probe instead of a reed contact. In a further modification the magnet of the magnetic field-actuated switch can be permanently mounted on the housing of the domestic appliance, regardless of whether a reed contact, a Hall probe or a different switching element is used. For safety reasons it is also conceivable to provide two magnetic field-actuated switches to detect the closed state of the door.

Figure 14:
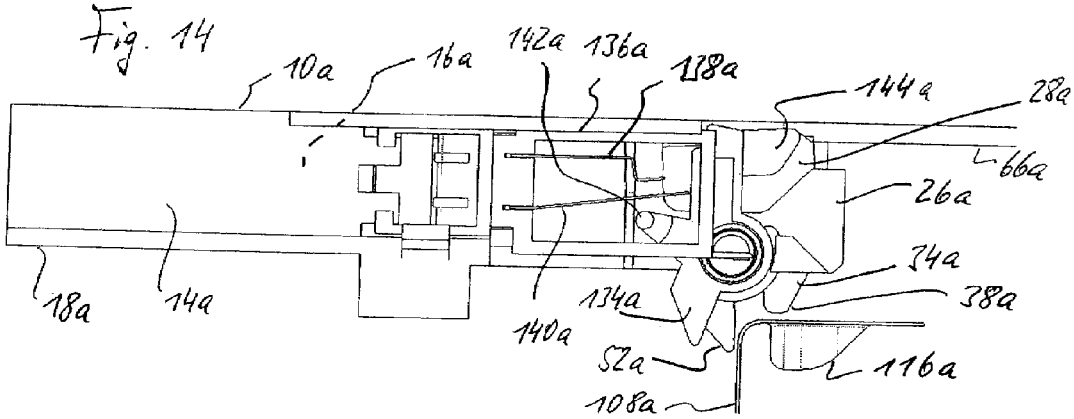
FIGS. 14 and 15 shows side views of a door latch device according to a second embodiment of the invention and FIG. 16 shows a longitudinal view of a door latch device according to third embodiment of the invention.
Figure 15:
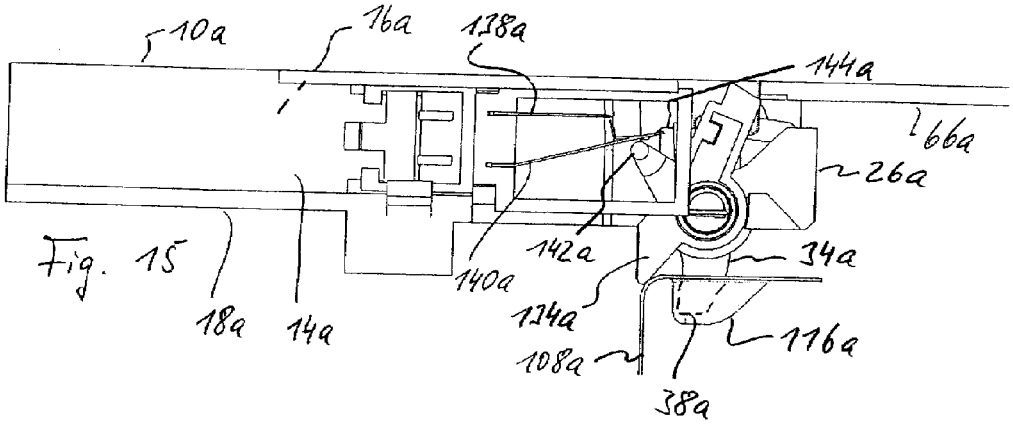
Figure 16:
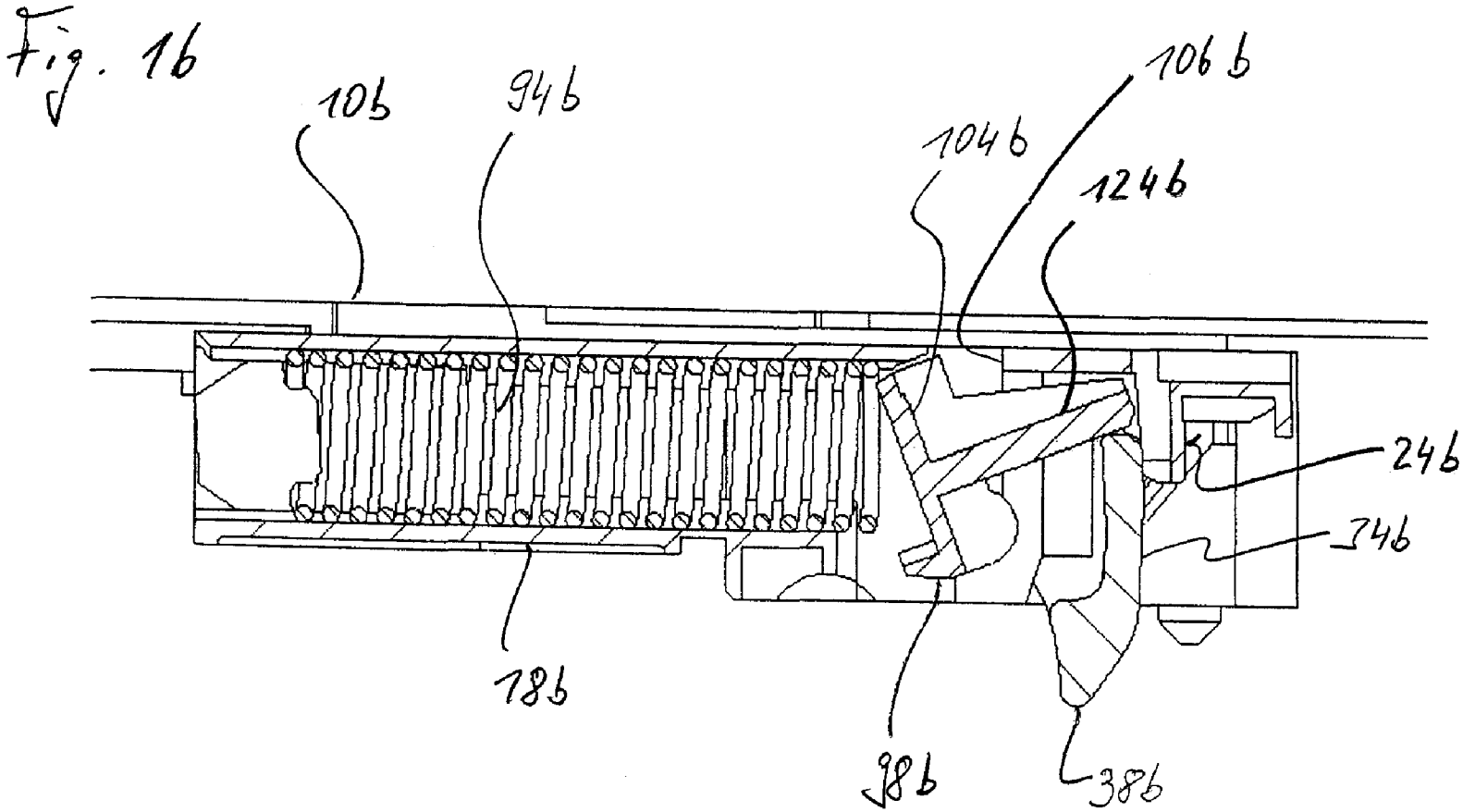

FIGS. 14 to 16 show variants to the embodiment described thus far. Identical components or components that have the same function are designated by the same reference characters in this figure as in the preceding figures, albeit supplemented by a lower case letter. To avoid unnecessary repetitions reference will be made to the above statements on the first embodiment to describe these components.

In the embodiment of FIGS. 14 and 15 a switch actuating member 134*a* is provided that is separate from the control lever 52*a* and can be moved independently thereof. It is provided on the frame 10*a* so as to swivel and is used to actuate an electric switch 136*a* mounted on the frame 10*a*. The switch actuating member 134*a* and the control lever 52*a* are arranged on opposing sides of the frame 10*a*.

The switch 136*a* contains two electrical switch contacts 138*a*, 140*a* which can be brought into electrical contact with each other by means of a mechanical switch actuating portion 142*a* arranged on the switch actuating member 134*a*. The switch actuating portion 142*a* can, for example, be a catch or mandrel formed on the switch actuating member 134*a* and which by way of swivelling the switch actuating member 134 can approach the contact 140*a* from below in order to thus press the contact 140*a* against the contact 138*a*. FIG. 14 shows the open state of the switch in which the two contacts 138*a*, 140*a* do not touch each other. FIG. 15 on the other hand shows the closed switch state in which the contact 140*a* is pressed against the contact 138*a*.

The switch actuating member 134*a* is actuated by the door 108*a* in a manner similar to the control lever 52*a*, although phase-shifted with respect to the control lever 52*a*. As may be seen from FIG. 14, as the door 108*a* approaches, the control lever 52*a* is actuated first before the door also meets the switch actuating member 134*a*. In its unlocked position, with a blocking portion 144*a* the latching member 28*a* blocks the switch actuating element 134*a* against swivelling out of the switch deactivation position shown in FIG. 14. To be able to swivel the switch activating member 134*a* in the direction of its switch activation position shown in FIG. 15 the blocking portion 144*a* must firstly be moved downwards before the switch actuating member 134*a* can move past the blocking portion 144*a*. The phase-shifted actuation of the control lever 52 and switch actuating member 134*a* causes the transverse web 34*a* with the latching nose 38*a*, and therewith the blocking portion 144*a* as well, to firstly be moved downwards by swivelling the control lever 52*a* as the door is closed. Only when the latching nose 38*a* is inserted into the latching depression 116*a* of the door 108*a* is the switch actuating member 134*a* released. It may thus be ensured that the switch 136*a* only outputs a signal when the door has been successfully locked.

In the third embodiment according to FIG. 16 the abutment member 98*b* acts directly on the transverse web 34*b* that forms the latching nose. A further transverse web arranged behind it, as in the first embodiment in the form of the transverse web 36, is omitted. The figure shows the door latch device in a self-healing state similar to FIG. 12. In this state the transverse web 34*b* is lifted upwards against the force of the latching spring 94*b* with simultaneous swivelling of the abutment member 98*b*. The function of the door latch device according to FIG. 16 completely matches that of the first embodiment moreover.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for a domestic electrical appliance, the appliance comprising a cabinet and a door for closing an access opening formed in the cabinet, the door latch comprising:

a frame for mounting on one of the cabinet and door and providing a blocking surface;

a latching device including a latching portion for latchingly engaging a closure portion provided at the other of the cabinet and door, the latching device disposed for movement relative to the frame between an open position and a latched position;

at least one biasing spring member for urging the latching device in the open position thereof into engagement with the blocking surface wherein, when the latching portion moves past the blocking surface, the biasing spring member relaxes to thereby cause movement of the latching device toward the latched position thereof; and a control member disposed for movement with respect to the latching device and the frame, wherein the control member comprising a first portion for engagement by an actuation portion of the other of the cabinet and door during closing of the door, and a second portion for acting, in response to engagement of the first portion by the actuation portion, on the latching device to move the latching portion past the blocking surface.

2. The door latch of claim 1, wherein the control member is mounted on the frame.

3. The door latch of claim 1, wherein the control member is a control lever supported for pivoting movement, the control lever comprising a first lever arm providing the impact portion and a second lever arm providing the engagement portion.

4. The door latch of claim 1, wherein the control member is movable between a rest position and a block-cancelling position and is resiliently biased towards the rest position.

5. The door latch of claim 1, further comprising an electric switch, wherein the control member includes a switch activation portion for activating the electric switch when the control member is moving from a rest position towards a block-cancelling position.

6. The door latch of claim 5, wherein the electric switch is a magnetic field-activated switch and the switch activation portion comprises a magnet providing a magnetic field for activating the switch.

7. The door latch of claim 6, wherein the magnetic field-activated switch is a Reed contact switch.

8. The door latch of claim 5, wherein the switch activation portion is adapted for mechanical activation of the switch.

9. The door latch of claim 1, wherein the latching device is formed as a single body comprising the latching portion, a blocking portion for blocking engagement with the blocking surface, and one or more support surfaces for the at least one biasing spring member.

10. The door latch device of claim 9, wherein the single-body latching device is integrally fabricated as one piece.

11. The door latch of claim 9, wherein the single-body latching device is formed as an elongate slide member mounted for longitudinal and pivoting movement with respect to the frame.

12. The door latch of claim 11, wherein the latching portion is formed in a first longitudinal end region of the slide member, and wherein the slide member is mounted for pivoting movement with respect to the frame about a pivot axis extending through the slide member in a second longitudinal end region of the slide member opposite to the first longitudinal end region.

13. The door latch of claim 11, wherein the latching portion is formed as a latching protrusion adapted for latchingly engaging in a closure recess formed at the other of the cabinet and door.

14. The door latch of claim 11, wherein the slide member comprises two spaced-apart longitudinal side legs accommodating the at least one biasing spring member therebetween.

15. The door latch of claim 14, wherein the side legs are connected by a transverse connecting web in a first longitudinal end region of the slide member and are unconnected over a main part of their length extending up to a second longitudinal end of the slide member, wherein the latching portion is formed in the first longitudinal end region.

16. The door latch of claim 15, wherein the at least one biasing spring member rests against one or more support surfaces formed at each side leg of the slide member in the second longitudinal end region thereof, and further rests against an abutment portion provided between the side legs of the slide member.

17. The door latch of claim 1, wherein the at least one biasing spring member comprises a single helical compression spring.

18. The door latch of claim 1, comprising an arresting member movably supported by the frame and arranged for manual operation to bring the arresting member in arresting engagement with the latching device in the latched position thereof whereby movement of the latching device back into the open position is prevented.

19. A door latch for a domestic electrical appliance, the appliance comprising a cabinet and a door for closing an access opening formed in the cabinet, the door latch comprising:

a frame for mounting on one of the cabinet and door and having a blocking surface;

a latching device including a latching portion for latchingly engaging a closure portion provided at the other of the cabinet and door, the latching device disposed for movement relative to the frame between an open position and a latched position;

at least one biasing spring member for urging the latching device in the open position thereof into engagement with the blocking surface wherein, when the latching portion moves past the blocking surface, the biasing spring member relaxes to thereby cause movement of the latching device toward the latched position thereof;

wherein the latching device is formed as a single body comprising a latching portion for latchingly cooperating with the closure portion, a blocking portion for blocking engagement with the blocking surface, and one or more support surfaces for the at least one biasing spring member.

20. A door latch for a domestic electrical appliance, the appliance comprising a cabinet and a door for closing an access opening formed in the cabinet, the door latch comprising:

a frame for mounting on one of the cabinet and door and having a blocking surface;

a latching device including a latching portion for latchingly engaging a closure portion provided at the other of the cabinet and door, the latching device disposed for movement relative to the frame between an open position and a latched position;

at least one biasing spring member for urging the latching device in the open position thereof into engagement with the blocking surface wherein, when the latching portion moves past the blocking surface, the biasing spring member relaxes to thereby cause movement of the latching device toward the latched position thereof;

an abutment member provided separately from the latching member and movably supported by the frame, the at least one biasing spring member resting against the abutment member;

wherein the latching device has freedom of movement in the latched position thereof to allow the latching portion to move out of a path of movement of the closure portion relative to the one of the cabinet and door during closing of the door against an elastic force, the elastic force generated by the at least one biasing spring member and transmitted to the latching device via the abutment member.

21. The door latch of claim 20, wherein the abutment member is mounted for pivoting movement with respect to the frame.

22. A door latch for a domestic electrical appliance, the appliance comprising a cabinet and a door for closing an access opening formed in the cabinet, the door latch comprising:

a frame for mounting on one of the cabinet and door and having a blocking surface;

a latching device including a latching projection for latchingly engaging in a closure recess provided at the other of the cabinet and door, the latching device disposed for movement relative to the frame between an open position and a latched position;

at least one biasing spring member for urging the latching device in the open position thereof into engagement with the blocking surface wherein, when the latching portion moves past the blocking surface, the biasing spring member relaxes to thereby cause movement of the latching device toward the latched position thereof;

wherein a trajectory of movement of the latching device from the open position to the latched position relative to the frame comprises a first part of substantially inserting the latching projection into the closure recess and a second part directed transversely to the first part, the latching projection moving along at least most of the first part while the latching device is still in blocking engagement with the blocking surface and moving along at least most of the second part once the latching device is released from blocking engagement with the blocking surface.

* * * * *